US005801327A

United States Patent [19]

Tobias

[11] Patent Number: 5,801,327

[45] Date of Patent: Sep. 1, 1998

[54] RADIALLY EXTENDING GROUND DEVICE

[75] Inventor: John M. Tobias, Toms River, N.J.

[73] Assignee: The United States of America as represented by the Secretary of the Army, Washington, D.C.

[21] Appl. No.: 838,816

[22] Filed: Apr. 10, 1997

[51] Int. Cl.[6] ..... H01R 4/66

[52] U.S. Cl. ..... 174/6; 174/51; 174/78; 439/92

[58] Field of Search ..... 174/2, 6, 51, 78, 174/3, 5 R, 55 B, 7, 1; 439/92, 426; 52/160; 173/90, 132

[56] References Cited

U.S. PATENT DOCUMENTS

| | | | |
|---|---|---|---|
| 1,013,305 | 1/1912 | Pardee | 174/6 |
| 1,681,699 | 8/1928 | Maple | 174/6 |
| 2,366,997 | 1/1945 | Brand | 52/160 |
| 2,522,879 | 9/1950 | Lindenblad | 174/6 |
| 2,545,048 | 3/1951 | Salmons | 174/6 |
| 3,281,520 | 10/1966 | Rocard | 179/6 |
| 4,031,284 | 6/1977 | Ingraham | 428/222 |
| 4,255,608 | 3/1981 | Bosch et al. | 174/5 R |

*Primary Examiner*—Kristine L. Kincaid
*Assistant Examiner*—Dhiru R. Patel
*Attorney, Agent, or Firm*—Michael Zelenka; John M. O'Meara

[57] ABSTRACT

A grounding device is disclosed which utilizes the superposition principle to preclude step voltage hazards. At least three conductors are included in the grounding device, each conductor being capable of extending radially from a common center with the adjacent radially extending conductors being separated by substantially equal angles. A plurality of electrically conductive stakes are affixed to each conductor and are engaged into the earth for conducting current thereinto. The stakes may be tapered to facilitate the engagement thereof into the earth, while a center plate may be utilized to connect the conductors to the common center.

9 Claims, 3 Drawing Sheets

RADIALLY EXTENDING GROUND DEVICE

GOVERNMENT INTEREST

The invention described herein may be manufactured, used, and licensed by or for the United States Government for governmental purposes without payment to me of any royalties thereon.

BACKGROUND OF THE INVENTION

The present invention relates to a grounding device, particularly such a device that functions to reduce the hazard caused by surface voltage gradients while being readily deployable at temporary installations.

Grounding devices for conducting current into the earth are well known in the art. For permanent installations having water or sewer pipes, various types of clamps can be used on such pipes to provide a low resistance ground. Such pipes are not usually available at temporary installations and therefore other types of grounding devices must be utilized.

Well known temporary grounding devices fall into two general categories, those that make subsurface contact with the earth and those that make surface contact with the earth. Of the subsurface types, the simplest and best known is the metal stake which is driven into the earth. The peripheral size of the stake and the subsurface characteristics of the earth at the particular grounding location, determine the depth to which the stake must be driven. A wire buried in a shallow ditch constitutes another subsurface type. The ditch is plowed into the earth and the length thereof is determined by the diameter of the wire and the subsurface characteristics of the earth at the particular grounding location. Of the surface types, the simplest is a mat of interwoven wire, which generally conforms to the contour of the earth's surface when disposed thereon. The area of the mat is determined by the weave mesh thereof and the surface characteristics of the earth at the particular grounding location. To improve electrical contact between the mat and the earth's surface, metal pegs are driven into the earth to press parts of the mat thereagainst. In another surface type, a wire is disposed on the earth and held thereagainst with metal pegs that are driven thereinto. The length of the wire is determined mostly by the surface characteristics of the earth at the particular grounding location and the number of pegs utilized.

Of course, installation of either a surface or subsurface type of grounding device requires time which is a precious commodity in urgent situations, such as when facilities for temporary use by the military in the field, are either deployed or removed. Only a few grounding devices of the surface type can be timely deployed or removed in urgent situations, and such timely deployment or removal is also a problem with many of the subsurface types.

SUMMARY OF THE INVENTION

It is the general object of the present invention to reduce the hazard caused by surface voltage gradients, with a grounding device that is quickly deployed or removed.

This and other objects are accomplished in accordance with the present invention, by structuring the grounding device with at least three electrical conductors which are each radially extendible from a common center and separated from adjacent conductors by substantially equal angular spacings. In the preferred embodiments, the conductors are flexible wire or cable, each having electrically conductive stakes affixed thereto. Also, the stakes can be tapered with conical or wedge configurations, so as to facilitate the penetration thereof into the earth. When practical the stake taper is determined in accordance with both the surface and subsurface characteristics of the earth at the location where current is to be discharged thereinto. Furthermore, the stakes may be separated along the conductors to determine the voltage gradient pattern on the earth's surface when current is discharged through the grounding device.

The scope of the present invention is only limited by the appended claims for which support is predicated on the preferred embodiments hereafter set forth in the following description and the attached drawings.

DESCRIPTION OF THE DRAWINGS

FIG. 2(*b*) is a plot of a typical step voltage characteristic for the current discharge in FIG. 2(*a*)

DESCRIPTION OF THE PREFERRED EMBODIMENTS

Figure 1:
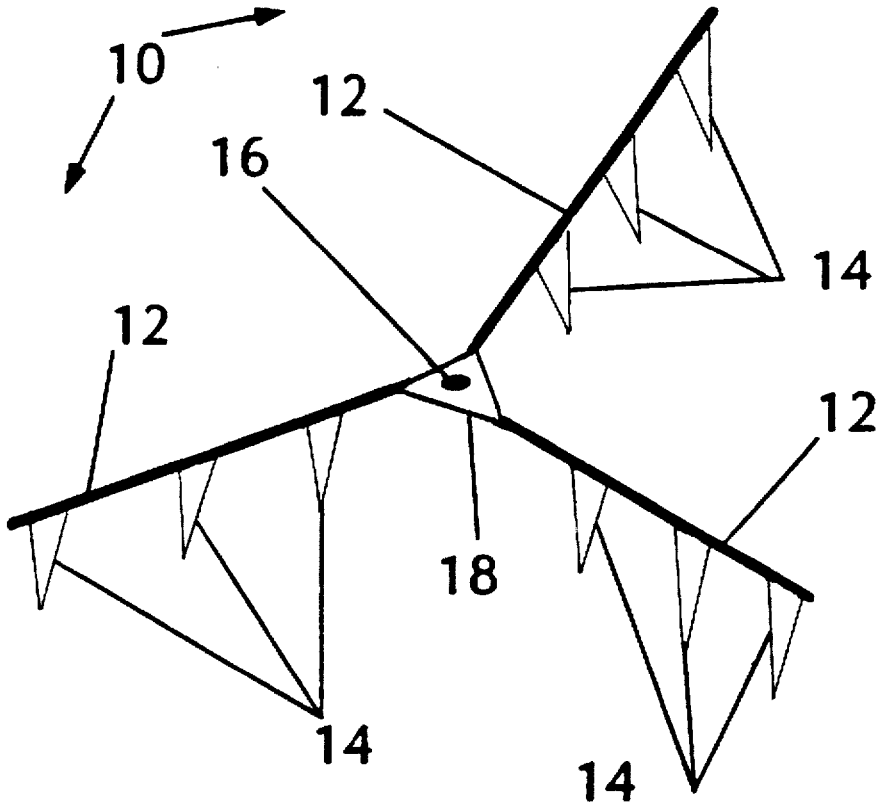
FIG. 1 is an isometric view of a grounding device in accordance with the invention.

The present invention relates to a grounding device 10 that reduces step voltage magnitudes which result when current is discharged therethrough into the earth. As shown in FIG. 1, grounding device 10 includes at least 3 electrical conductors 12 and a plurality of electrically conductive stakes 14 affixed to each conductor 12. The conductors 12 are each radially extendible from a common center 16, with substantially equal angular spacings separating between adjacent conductors 12. Although a center plate 18 to which one end of each conductor 12 is affixed may be utilized as shown in FIG. 1, the conductors 12 could merely be electrically interconnected at the common center 16.

Fabrication of the conductors 12 is preferably accomplished using stranded wire or cable which permits storage configuration flexibility and thereby provides for the grounding device 10 to be portable. As to the stakes 14, fabrication may be accomplished in various ways, such as by welding a metal cylinder through which the conductors 12 can slide, to a triangularly shaped metal plate and incorporate screws or bolts to affix the cylinders at any desired location along the conductors 12.

When employing the grounding device 10, it is disposed on the earth and the conductors 12 are extended radially from the common center 16. Force is then applied to engage the stakes 14 into the earth, such as with a sledge hammer. When included in the grounding device 10, the center plate 18 is located on the surface of the earth prior to extending the conductors 12 and the items to be grounded are electrically interconnected thereto. Otherwise, the items to be grounded would be electrically interconnected with the conductors 12, such as at the common center 16 which is then located on the surface of the earth prior to extending the conductors 12 therefrom.

Although the stakes 14 could have many different configurations, a configuration which provides a taper to facilitate deployment of the grounding device 10, is desirable. If the surface and subsurface characteristics of the earth are known at the location where a ground is to be provided, the taper slope should be in accordance therewith. For hard or crusted surfaces and compact or dense subsurfaces, the angle of the taper relative to the earth should be larger than for granular or soft surfaces and loose or damp subsurfaces. Either conical or wedge configurations could be utilized to derive the taper shown in FIG. 1. Both the conductors 12 and the stakes 14 may be fabricated of any electrically conductive material, such as steel. Each stake 14 is affixed at a location along its conductor 12 and a voltage gradient will pass radially therefrom over the surface of the earth when current is discharged therethrough.

Figure 2A:
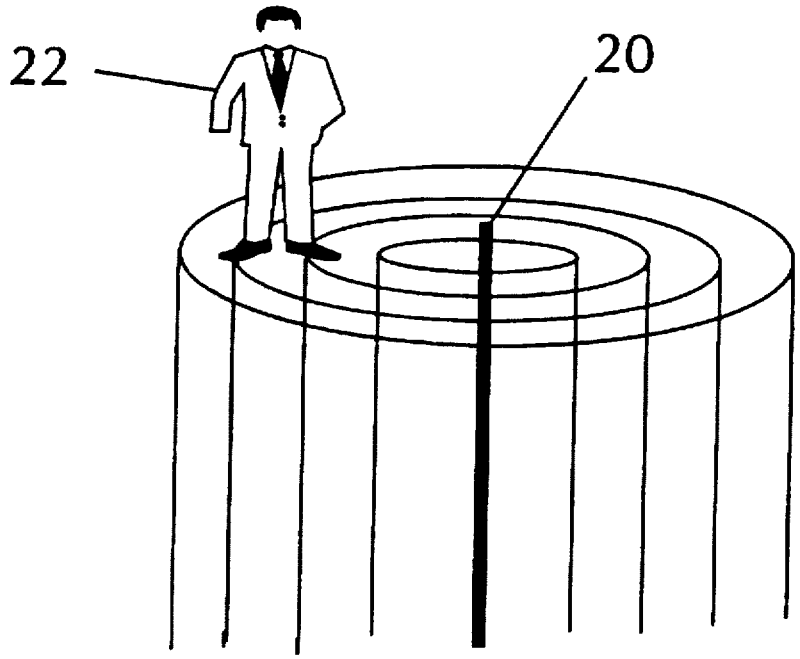
FIG. 2(*a*) is a voltage gradient representation relative to current discharge into the earth at a single point on the surface thereof.
Figure 2B:
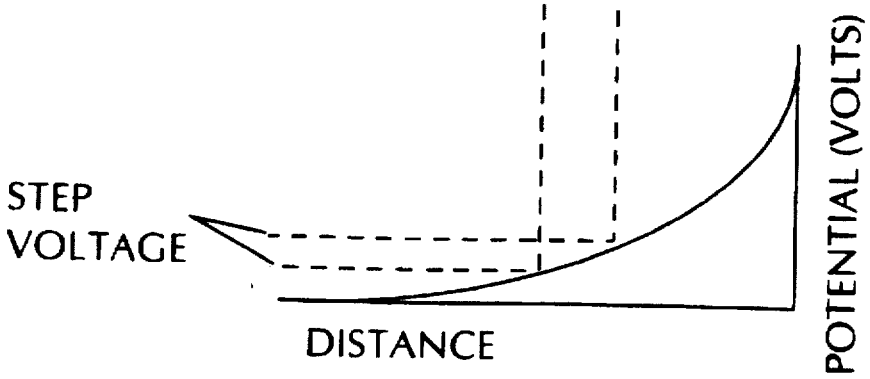

Although surface voltage gradient patterns may result from other atmospheric conditions, in FIG. 2(*a*) the gradient pattern results from a lighting bolt which injects current into the earth at point 20. As illustrated in FIG. 2(*b*), voltage magnitudes in this pattern decrease logarithmically in any radial direction, as distance from point 20 increases and the equi-potential levels are generally circular thereabout. However, such voltage magnitudes are in accordance with the prevailing discharge conditions and could therefore decrease linearly or in some other manner as the distance from point 20 increases. For a man 22 walking on the earth near point 20 in FIG. 2(*a*), step voltages will be encountered between his feet as shown in FIG. 2(*b*). Depending on the current magnitude discharged into the earth, very high step voltages can be experienced near point 20, which would present an injury hazard. This can be readily understood by those skilled in the electrical arts from the plot of the surface voltage versus distance in FIG. 2(*b*) which as shown therein, may be used to determine the step voltage magnitude at various locations.

The injury hazard discussed above relative to FIGS. 2(*a*) and 2(*b*) is greatly reduced when the grounding device 10 of the invention is utilized. One reason for this reduction is that the equipotential levels in the surface voltage gradient which passes radially from each stake 14 in the grounding device 10, would be of much lesser magnitude than those relating to the single location discharge at point 20 in FIG. 2(*a*). Another reason for this reduction is that the principle of superposition applies to grounding device 10 when the current being discharged into the earth reaches some elevated level, but never applies for the single location discharge shown in FIG. 2(*a*). To appreciate this, one must realize that when the previously mentioned elevated current level is reached, the surface voltage gradient pattern about each stake 14 extends into the surface voltage gradient patterns of adjacent stakes 14, whether the adjacent stakes 14 are located on the same conductor 12 or on adjacent conductors 12. Consequently, the surface voltage encountered at any location between adjacent stakes 14 will be greater than that which would be encountered for either stake 14 alone. However, the surface voltage gradient therebetween will be flatter, with the maximum step voltage being X by comparison to Y for either stake 14 alone, as illustrated in FIG. 3.

Figure 3:
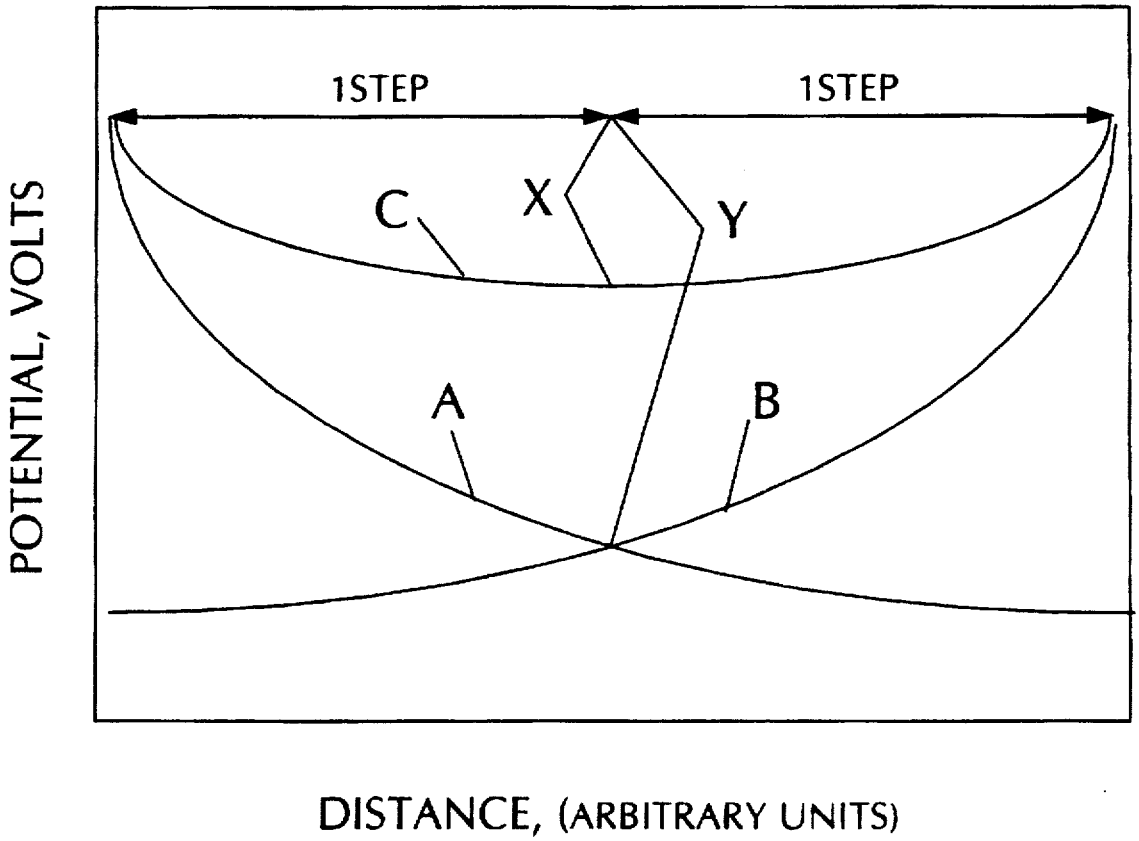
FIG. 3 illustrates the superposition principle in regard to surface voltage gradients which originate from separate points on the earth's surface.

Logarithmically decreasing surface voltage gradient plots A & B relating to adjacently disposed stakes 14 (not shown) are superpositioned in FIG. 3. Plot A relates to one adjacent stake located along the left side ordinate and Plot B relates to the other adjacent stake located along the right side ordinate. Flattened Plot C is the surface voltage gradient which results due to the superpositioning of Plots A and B. The higher surface voltages of Plot C result in lower step voltages than do the lower surface voltages of either Plot A or Plot B alone, as demonstrated in FIG. 3 wherein the adjacent stakes 14 are separated by a distance of two steps. When Plots A and B are superpositioned therefore, the maximum voltage hazard encountered in any step is greatly reduced relative to that encountered for either Plot A or Plot B alone. Of course, the superposition principle could also apply when the distance between adjacent stakes 14 is either greater than or less than two steps. Otherwise, when the superposition principle is applied to derive protection against step voltage hazards, the number of conductors 12 and stakes 14 utilized in the grounding device 10 must be determined in accordance with the area over which such protection is desired. Of course, the greater the number of conductors 12 and stakes 14 utilized, the less portable the grounding device 10 becomes, and its deployment and removal becomes more difficult.

Current will also be discharged into the earth at any location where the conductors 12 and plate 18 (when utilized), are in contact therewith. Although the superposition principle will also apply to these locations, the resistance encountered thereat will usually be much greater than that encountered by the stakes 14. Therefore, the magnitude of current discharged at these locations will be much less and thereby result in much lower surface voltage gradients.

As will be understood without further explanation by those skilled in the electrical arts, the resistance encountered through the grounding device 10 and into the earth depends on the number of stakes 14 utilized on the device 10, as well as the pattern of and spacing between those stakes 14. Although many combinations of these factors are possible to determine the resistance, all of these factors should be considered for each particular application of the grounding device 10. Otherwise, the stakes 14 would be separated along each conductor 12 in accordance with the surface voltage gradients expected to exist thereabout when an anticipated level of current discharge occurs therethrough. Although the stakes would be separated uniformly at equal distances in most grounding applications, it is possible for the stake separation to be progressively greater and/or less as distance from the common center 16 increases, if necessary. Furthermore, when the stakes 14 are separated at an equal distance, that distance may be the step distance of a person or twice the step distance of a person.

Those skilled in the art will appreciate without any further explanation that within the concept of this invention many modifications and variations are possible to the above disclosed embodiments of the grounding device 10. Consequently, it should be understood that all such variations and modifications fall within the scope of the following claims.

What I claim is:

1. A grounding device for conducting current into the earth, comprising:

at least three electrical conductors which are radially extendible from a common center in directions to separate the radially extendible conductors at substantially equal angles; and a plurality of electrically conductive stakes affixed to each of the conductors;

the grounding device being deployed to ground items electrically connected thereto by interconnecting the conductors at the common center and forcing the stakes into the earth after fully extending the conductors from the common center.

2. The grounding device of claim 1 wherein the stakes have a tapered configuration to facilitate their being forced into the earth.

3. The grounding device of claim 2, wherein the tapered configuration of the stakes is in accordance with both the surface and subsurface characteristics of the earth at a location on the earth where current is to be conducted into the earth.

4. The grounding device of claim 3, wherein the stakes have a conical configuration.

5. The grounding device of claim 3, wherein the stakes have a wedge configuration.

6. The grounding device of claim 3, wherein the stakes have a triangular configuration.

7. The grounding device of claim 1, wherein the stakes are separated along each of the conductors in accordance with the surface voltage gradients expected to exist thereabout when an anticipated level of current discharge occurs therethrough.

8. The grounding device of claim 7, wherein the stakes are separated at equal distances.

9. The grounding device of claim 1, wherein the conductors are connected to an electrically conductive center plate and the grounding device is deployed by locating the plate on the surface of the earth and forcing the stakes thereinto after fully extending the conductors from the center plate.

* * * * *